US009913519B2

(12) United States Patent
Shami

(10) Patent No.: US 9,913,519 B2
(45) Date of Patent: Mar. 13, 2018

(54) HAIR IRON AND HEAT TRANSFER MATERIAL FOR HAIR IRON

(71) Applicant: Farouk Systems, Inc., Houston, TX (US)

(72) Inventor: Farouk M. Shami, Houston, TX (US)

(73) Assignee: Farouk Systems, Inc., Houston, TX (US)

( * ) Notice: Subject to any disclaimer, the term of this patent is extended or adjusted under 35 U.S.C. 154(b) by 243 days.

(21) Appl. No.: 14/734,189

(22) Filed: Jun. 9, 2015

(65) Prior Publication Data

US 2016/0360846 A1 Dec. 15, 2016

(51) Int. Cl.

| | |
|---|---|
| ***A45D 1/00*** | (2006.01) |
| ***A45D 1/04*** | (2006.01) |
| ***H05B 3/24*** | (2006.01) |
| ***H05B 3/30*** | (2006.01) |
| *A45D 2/00* | (2006.01) |

(52) U.S. Cl.

CPC ..... *A45D 1/04* (2013.01); *H05B 3/24* (2013.01); *A45D 1/00* (2013.01); *A45D 2/001* (2013.01)

(58) Field of Classification Search

CPC ..... A45D 1/04; A45D 2/001; A45D 2/40

USPC ..... 250/423 R; 219/222; 132/223, 227, 229, 132/271

See application file for complete search history.

(56) References Cited

U.S. PATENT DOCUMENTS

| | | | | |
|---|---|---|---|---|
| 4,390,498 | A * | 6/1983 | Luyckx | C22C 35/005 420/417 |
| 7,261,782 | B2 * | 8/2007 | Hwang | C22F 1/183 148/421 |
| 2007/0068548 | A1 * | 3/2007 | Wong | A45D 1/04 132/232 |
| 2008/0053982 | A1 * | 3/2008 | Ceva | A45D 1/04 219/225 |
| 2009/0260651 | A1 * | 10/2009 | Chan | A45D 1/04 132/269 |
| 2009/0272731 | A1 * | 11/2009 | Olding | C08L 71/00 219/482 |
| 2010/0078037 | A1 * | 4/2010 | Mukai | A45D 1/04 132/223 |
| 2011/0240055 | A1 * | 10/2011 | Murzynski | A45D 1/00 132/212 |
| 2013/0146081 | A1 * | 6/2013 | Chan | A45D 2/001 132/229 |
| 2013/0331500 | A1 * | 12/2013 | Yokoe | B29C 67/246 524/502 |
| 2015/0344722 | A1 * | 12/2015 | Lin | C09D 4/00 428/412 |
| 2016/0271646 | A1 * | 9/2016 | deGrood | A45D 1/06 |
| 2017/0231356 | A1 * | 8/2017 | Samain | A45D 19/02 132/201 |

FOREIGN PATENT DOCUMENTS

| | | | | |
|---|---|---|---|---|
| RU | 2214892 C1 * | 10/2003 | | |
| WO | WO 2009030941 A2 * | 3/2009 | | A45D 1/04 |

* cited by examiner

*Primary Examiner* — Joseph M Pelham
(74) *Attorney, Agent, or Firm* — Blank Rome, LLP

(57) ABSTRACT

A hair iron has at least one heat transfer element that includes a substrate and a coating deposited on the substrate, the coating having a composition with at least 50 percent by mass of titanium and zirconium, a heating element, and an insulated grip region.

9 Claims, 3 Drawing Sheets

HAIR IRON AND HEAT TRANSFER MATERIAL FOR HAIR IRON

BACKGROUND

Hair irons and hair heating devices are currently used for a variety of hair-styling applications. For example, rounded hair irons may be used for curling hair, flat irons may be used for straightening hair or for some curling techniques, and crimping irons, having undulating heatable surfaces, which may be used for crimping hair.

Hair irons typically include at least one heatable surface, heated with a heating element, which may be controlled to stay within a desired temperature range, and an insulated griping region.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a hair iron having at least one heat transfer element including a substrate and a coating deposited on the substrate, the coating having a composition with at least 50 percent by mass of titanium and zirconium, a heating element, and an insulated grip region.

In another aspect, embodiments of the present disclosure relate to a method of making a hair iron that includes depositing ionized titanium and zirconium onto a surface of a metallic substrate to form a heat transfer element and assembling the heat transfer element to a heating element and an insulation element to form the hair iron.

Other aspects and advantages of the invention will be apparent from the following description and the appended claims.

DETAILED DESCRIPTION

Embodiments disclosed herein may relate generally to hair irons. More particularly, some embodiments disclosed herein may relate to heat transfer elements used in hair irons and methods for making such heat transfer elements.

Hair irons may generally include at least one heat transfer element heated by a heating element and an insulated grip region for holding and maneuvering the hair iron when heated. The heat transfer element may have a working surface, i.e., a surface that contacts hair, with a planar or non-planar geometry, depending on the type of hair iron. For example, a flat iron (e.g., which may be used to straighten hair) may include heat transfer elements with planar working surfaces, a crimping iron (e.g., which may be used to crimp or undulate hair) may include heat transfer elements with corresponding and mating non-planar working surfaces, and a curling iron (e.g., which may be used to curl hair) may include a heat transfer element with a rounded non-planar working surface. The insulated grip region may be of various shapes and sizes, depending on the type of hair iron, but may be designed to have a large enough area for a user to grip without contacting the heat transfer element and heating element. Insulated grip regions may also be designed to include compartments or regions for holding electrical components.

Figure 1:
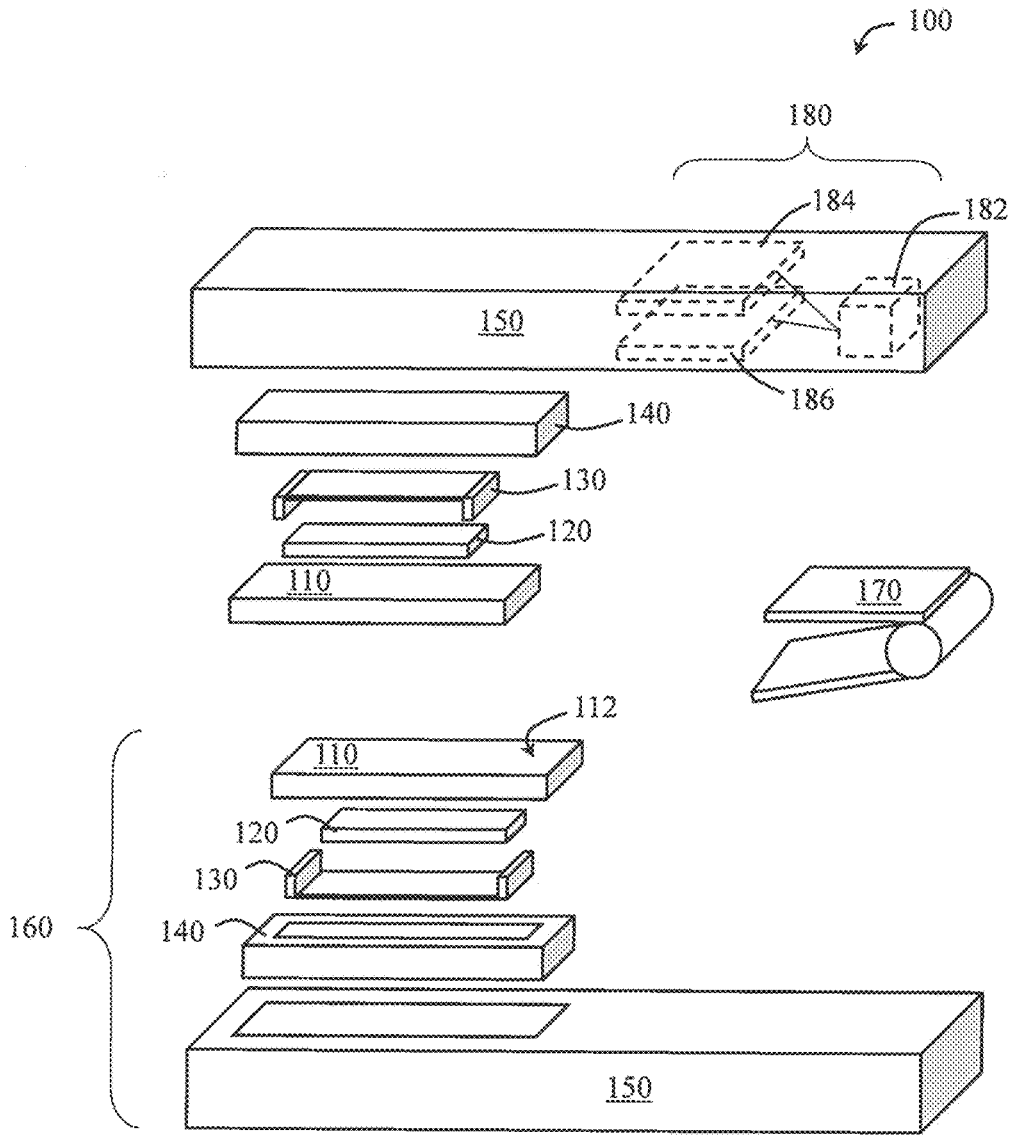
FIG. 1 is a schematic of an unassembled hair iron according to embodiments of the present disclosure.

FIG. 1 shows a schematic of an example of an unassembled hair iron 100. When assembled, the hair iron 100 is a flat iron having a top arm and a bottom arm 160 that may close around hair to straighten it. The top and bottom arms each include a heat transfer element 110 having a planar working surface 112, where the working surface 112 is configured to contact hair when the iron 100 is in use. A heating element 120 may be attached to or otherwise positioned adjacent to each heat transfer element 110 such that the heating element 120 may heat the heat transfer element 110. For example, a heating element 120 may be attached to a heat transfer element 110 via an adhesive, such as a thermally conductive epoxy. Each heating element 120 may have a support 130, which may be used to secure the heating element 120 to one or more other components of a hair iron, to restrict movement of the heating element 120, and/or to support the heating element 120. An insulator 140 may be disposed partially around the support 130 and attached to an insulated grip element 150. The assembled heat transfer element 110, heating element 120, support 130, insulator 140 and insulated grip element 150 may form an arm of the iron 100. In the embodiment shown, the heat transfer element 110 may be assembled to the heating element 120, support 130, insulator 140, and insulated grip element 150 such that the working surface 112 is exposed and the remaining portion of the heat transfer element 110 is embedded within the arm.

The top and bottom arms 160 may be pivotally connected by a connection element 170, such as, for example, a spring loaded hinge, or other hinge type. The connection element 170 may have restricted rotational movement or a separate component may be used to restrict relative rotational movement between the arms. Further, in some embodiments, a separate component may be used, such as a spring, to separate and to bias apart the top and bottom arms until a user compresses the arms together. The connection element 170 may be positioned at a distal end of the top and bottom arms 160, opposite the end of the arms having the working surfaces 112 of the heat transfer elements 110 exposed. Although FIG. 1 shows an embodiment having heat transfer elements assembled to a flat iron having two arms that may close around hair to straighten the hair, other embodiments may include one or more heat transfer elements configured in other hair iron types and designs. For example, in some embodiments, a hair iron may have a single heat transfer element assembled to a single arm structure without an arm connection element.

Further, in the embodiment shown in FIG. 1, the insulator 140 and the insulated grip element 150 are shown as separate components. However, in other embodiments, a single insulated grip element may be used, or more than two insulation components may be assembled together to form an insulated grip element. As used herein, an insulation element may refer to an element or component made of any suitable material having heat resistance properties sufficient for functioning in a hair iron. One or more insulation elements assembled together to prevent or reduce heat transfer from a heating element to a selected region and to provide a grip region (for holding the hair iron) may be referred to collectively as an insulated grip region. Suitable material for forming one or more insulation elements may include but is not limited to foam, foam polymer, glass foam, plastics, high temperature silicone bonded mica laminate, silica aerogel, carbon aerogel, alumina aerogel, or chalcogel. According to some embodiments, one or more insulation elements may be formed of a material having a thermal conductivity of about 0.2 Watts/(meter*Kelvin) or less.

Other listed elements shown in FIG. 1 may be formed as separate components that are assembled together to form an element, or multiple elements may be formed together as an integral element performing more than one function. For example, a heating element and a support may integrally be formed together as a heating element having a support region integrally formed therewith.

Although not shown in FIG. 1, hair irons may have electrical components housed therein, for example, to power a heating element, to control temperature, to activate ion generation from an ion generator, to turn on and off, and to display activated settings. Electrical components of a hair iron may include but is not limited to one or more of the following electrical component types: circuit boards, microprocessors, voltage regulators, LCDs (liquid-crystal displays) or other display screens, audio buzzers, current controllers, buttons, electrical communication means, thermistors, and thermal fuses, for example. Further, electrical components may be housed in an insulated region of a hair iron.

Hair irons according to embodiments of the present disclosure may also have one or more ion generators. An ion generator may include a power supply, an anode and a cathode assembled within a hair iron. For example, an ion generator may include a high voltage generator connected to one or more needle shaped electrodes and to a ground electrode spaced apart from the needle electrodes. The high voltage generator may apply a negative high voltage to the needle electrode relative to the ground electrode such that a corona discharge occurs between the electrodes to generate ions. In some ion generators, such as shown in FIG. 1, an ion generator 180 may include a power supply 182 connected to two electrode plates (an anode 184 and a cathode 186) that are spaced apart a selected distance, where once a voltage is applied, ions are generated between the spaced apart electrodes. Other ion generators (including those having different power sources and differently shaped electrodes) may be used with hair irons of the present disclosure. Further, a channel and optionally a fan may be disposed through a housing of a hair iron holding an ion generator, such that the ions generated by the ion generator may be directed through the channel and out one or more outlets. For example, a channel may direct ions produced by an ion generator through outlets formed through a heat transfer element (e.g., through a plurality of holes formed through the heat transfer element) or a channel may direct ions produced by an ion generator through one or more outlets formed adjacent or proximate to a heat transfer element.

According to embodiments of the present disclosure, a heat transfer element may include a substrate having a coating thereon, where the coating forms the working surface of the heat transfer element. The substrate may be made of any suitable material having a high thermal conductivity sufficient for transferring heat from the heating element in a hair iron. For example, a substrate may be a metallic substrate including at least one metal selected from aluminum, brass, copper, gold, silver, and alloys thereof. Other suitable substrate material may include but is not limited to one or more materials selected from aluminum, brass, calcium, copper, gold, titanium, chromium, manganese, iron, silver, strontium, barium, lanthanum, cerium, praseodymium, neodymium, lead, thorium, silicon, and combinations thereof. According to embodiments of the present disclosure, substrates may have a thermal conductivity of about 200 W/(mK) or greater.

The coating may be formed of a composition having a majority of titanium and zirconium, i.e., at least 50 percent by mass titanium and zirconium. According to some embodiments, the coating may have a composition with greater than 50 percent and up to 75 percent by mass of titanium and between 1 and 10 percent by mass of zirconium. According to some embodiments, in addition to a majority of titanium and zirconium composition, a coating composition may also include one or more trace metal elements, such as chromium, nickel, and copper. For example, a coating may have a composition including greater than 50 percent and up to 75 percent by mass titanium, between 1 and 10 percent by mass of zirconium, and between 5 and 25 percent trace metal elements. According to some embodiments, a coating may also have a silver color toner, such as titanium, zirconium, chromium or other silver colored alloy, and may form between 1 and 5 percent by mass of the coating composition. According to some embodiments, a coating composition may include between 60 and 70 percent by mass titanium, between 2 and 8 percent by mass zirconium, between 20 and 30 percent by mass trace metal elements and between 2 and 8 percent by mass a silver color toner.

The coating may have a ceramic or a metallic-ceramic composite composition. For example, the coating may have a layered composition, where different layers of the coating have different compositions. For example, a coating may include at least two layers, where at least one layer is a metallic layer formed of ionized titanium and at least one layer is a ceramic layer formed of ionized zirconium dioxide. According to some embodiments, a coating may be formed of three layers, a first layer formed of ionized titanium, a second layer formed of ionized chromium oxide and zirconium dioxide, a third layer formed of ionized zirconium. In some embodiments, a coating may be formed of more than three layers, where at least one layer includes ionized titanium and at least one layer includes ionized zirconium.

Coatings according to embodiments of the present disclosure may have a glossiness greater than 400 GU, greater than 450 GU, or greater than 500 GU, when measured with a gloss meter using a 60° measurement angle.

Further, coatings according to embodiments of the present disclosure may produce up to about 500 ion/cm$^3$ when heated to temperatures of at least 60° C. In some embodiments, a coating may produce at least 550 ion/cm$^3$ and up to about 600 ion/cm$^3$ when heated to temperatures of about 60° C. or greater. Hair irons having working surfaces formed of the coating compositions disclosed herein and having an ion generator may produce ion volumes in excess of 200,000 ion/cm$^3$, 250,000 ion/cm$^3$, and greater than 300,000 ion/cm$^3$, including ions generated from the coating and from the ion generator.

According to embodiments of the present disclosure, a coating having a majority composition titanium and zirconium may have a thickness ranging from about 0.1 μm to about 0.5 μm, or from about 0.2 μm to about 0.4 μm, for example 0.3 μm, where a coating thickness is measured perpendicularly from an outer surface of the substrate on which the coating is applied to a working surface formed by the outermost surface of the coating. In some embodiments, a coating having a majority composition titanium and zirconium may have a thickness less than ¼, less than ⅛, or less than 1/16 the thickness of the substrate on which the coating is applied.

A coating with a majority composition titanium and zirconium may be deposited on a planar or non-planar outer surface of a substrate to form a corresponding planar or non-planar working surface. In other words, an outer surface of a substrate having a planar or non-planar geometry may be coated with a conformal coating to form a corresponding planar or non-planar working surface.

Figure 2:
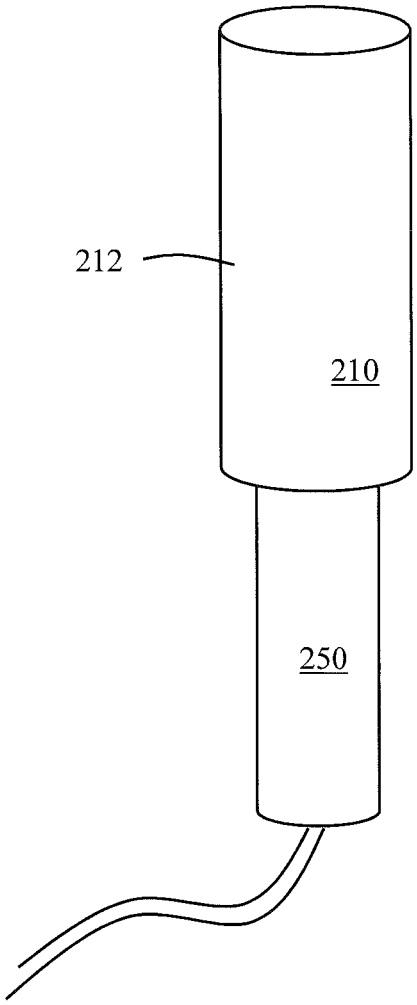
FIG. 2 shows a hair iron according to embodiments of the present disclosure.

For example, referring again to FIG. 1, the heat transfer element 110 may be formed by depositing a conformal coating onto a planar outer surface of a substrate, where the coating forms the planar working surface 112. FIG. 2 shows an example of a hair iron 200 having a heat transfer element 210 forming a non-planar working surface 212 and an insulated grip region 250. The heat transfer element 210 may extend around and be heated by a heating element (not shown). In the embodiment shown, the non-planar working surface 212 is rounded, extending circumferentially around a length of the hair iron. The rounded working surface 212 may be formed of a coating deposited on an outer surface of a substrate having corresponding geometry, where the coating includes a majority composition by mass of titanium and zirconium. In yet other embodiments, a hair iron may include two heat transfer elements having corresponding and mating non-planar working surfaces, where the working surfaces are formed of a coating having a majority composition titanium and zirconium deposited on a substrate.

According to embodiments of the present disclosure, a method of making a hair iron may include making one or more heat transfer elements by depositing ionized titanium and zirconium onto a surface of a metallic substrate. The heat transfer element may be assembled to a heating element and an insulation element, with optional components disposed there between, to form a hair iron. Additional components may be assembled with the heat transfer element, heating element and insulation element to form the hair iron, such as electrical components, additional insulation elements, connection elements, and an ion generator, to name a few.

A coating having a majority composition titanium and zirconium may be deposited by chemical ionization onto a substrate in a selected gas environment, such as an oxygen-containing environment, a nitrogen environment and/or a reduced oxygen environment. The coating may be deposited by one or more deposition processes, where each deposition process may include depositing one or more precursors in a selected environment. Different precursors may be deposited in different gas environments or in the same gas environment. For example, one or more precursors may be deposited in an oxygen-containing environment and one or more precursors may be deposited in an oxygen-free environment, such as a nitrogen environment. According to some embodiments, coating may include depositing one or more precursors in a nitrogen environment (having no oxygen present), flushing the nitrogen environment and replacing the nitrogen gas with an oxygen-containing gas, and depositing one or more precursors in the oxygen-containing environment. Other embodiments may utilize more than two deposition processes. Further, the type of environment a precursor is deposited in (e.g., nitrogen, oxygen, or an inert gas) may vary depending on the type of precursor being deposited.

Coating precursors may be selectively deposited, either individually or together. For example, coating precursors may be deposited onto one or more substrates during coating in an alternating arrangement or two or more precursors may be deposited at the same time.

For example, according to embodiments of the present disclosure, a titanium source, e.g., a titanium chemical vapor precursor, may be supplied within a vacuum oven from a distance apart from one or more substrates (on which the coating is to be applied). The vacuum oven may be filled with a nitrogen gas, such that the titanium deposition process is conducted in a nitrogen only environment. The titanium source may be energized as titanium ions, which bombard and coat the substrates. In some embodiments, the ions of titanium may be formed in an ion gun, and are shot towards the substrates to form a conformal coating thereon. After depositing a desired amount of titanium ions onto the substrates, the nitrogen gas may be flushed from the vacuum oven and replaced with an oxygen-containing environment. In a subsequent deposition process, a zirconium source, e.g., a zirconium chemical vapor precursor, may be supplied within the vacuum oven from a distance apart from the substrates. The zirconium source may be energized as zirconium ions, which bombard and coat the substrates in the oxygen-containing environment. In some embodiments, the zirconium ions may bond with oxygen from an oxygen-containing environment, such that zirconium dioxide is deposited onto the substrates (or any prior layer of the coating deposited on the substrates). Further, one or more other precursors may be deposited in addition to the zirconium precursor, either together or sequentially, with the zirconium. For example, a layer of ionized chromium oxide and ionized zirconium dioxide may be deposited (in a single deposition process) in an oxygen-containing environment.

Prior to deposition, one or more substrates may be placed in a vacuum oven, and the vacuum oven may be heated to a deposition temperature ranging from about 190° C. to 290° C. For example, in some embodiments, the oven may be heated to a deposition temperature of about 200° C. The deposition temperature may be held constant or may vary during deposition of ionized titanium and ionized zirconium and may be selected, for example, depending on the ionization process and the ratio of the titanium and zirconium ions. The deposition temperature may be held for a selected duration, depending on, for example, the thickness of the coating being applied. Further, the coating may be deposited in a vacuum environment. For example, ionized titanium and ionized zirconium may be deposited in a heated and pressurized environment having a pressure ranging between $2\times10^{-1}$ Pa and $3\times10^{-1}$ Pa and a deposition temperature of between 190° C. to 290° C.

According to some embodiments, one or more substrates, such as metallic plates, may be disposed within a vacuum oven. The vacuum oven may be heated to a deposition temperature of about 200° C. and pressurized to a vacuum environment. The metallic plates may be secured within the vacuum oven and either rotated or held in a stationary position as ionized titanium and ionized zirconium is deposited on an outer surface of the metallic plates. The vacuum oven may be filled with nitrogen gas, such that the ionized titanium may be coated onto the metallic plates in a nitrogen environment, and then flushed and replaced with an oxygen-containing gas, such that the ionized zirconium may be deposited in an oxygen-containing environment. The metallic plates may be held in the heated vacuum oven for at least 2 hours while the ionized titanium and ionized zirconium is being deposited. In embodiments having one or more metallic substrates being rotated during the deposition process, the ionized titanium and ionized zirconium may be deposited uniformly across the outer surface of each metallic substrate.

Prior to deposition, substrates may be cleaned using one or more cleaning steps. For example, substrates may be cleaned by washing one or more outer surfaces with distilled water, such as by submersing the substrates in the distilled water or by spraying the substrates with distilled water. In some embodiments, substrates may be cleaned by chemical etching, i.e., submersing one or more surfaces in a chemical liquid bath (in addition to or in alternative to cleaning with distilled water). For example, a metallic substrate may be submersed in a chemical liquid bath, such as an alkaline cleaning solution, for between 30 minutes to 2 hours, or for a time until the outer surface of the metallic substrate is shiny.

Prior to cleaning a substrate, the substrate may be polished. An outer surface of a substrate (on which a coating is to be deposited) may be polished until the outer surface is smooth and shiny.

Figure 3:
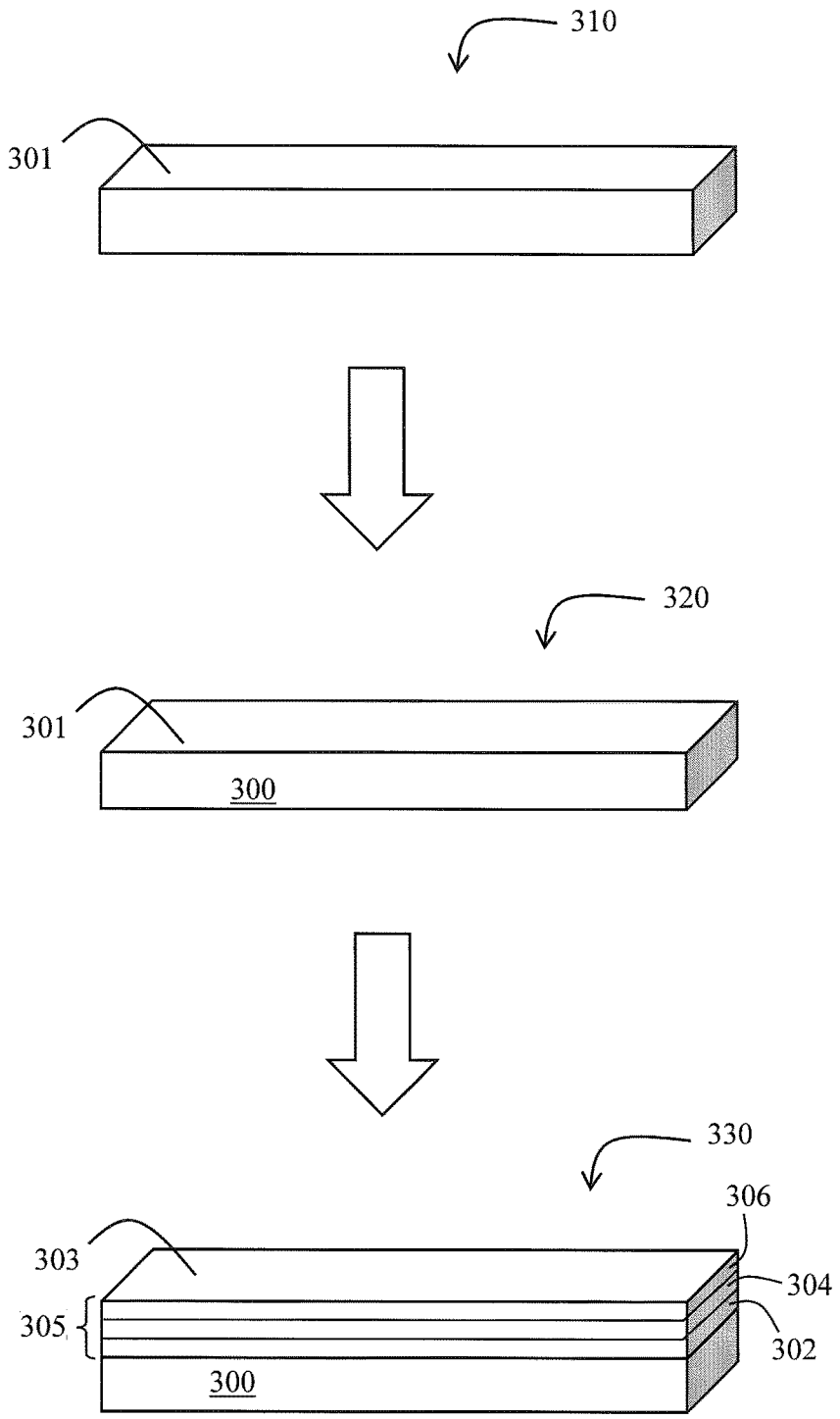
FIG. 3 shows a method for forming a heat transfer element according to embodiments of the present disclosure.

FIG. 3 shows an example of a method for forming a heat transfer element according to some embodiments of the present disclosure. As shown, a metallic substrate 300 having a planar outer surface 301 may be formed of a suitable substrate material having a thermal conductivity of at least 201 Watts/(meter*Kelvin). The outer surface 301 may be polished or buffed until smooth and shiny, for example, using a fine grit abrasive such as 120, 220, 320 and/or 400 grit. After the polishing step 310, the substrate 300 may be cleaned in one or more cleaning steps 320. For example, the polished outer surface 301 may be rinsed in distilled water. After rinsing the substrate 300 with distilled water, the outer surface 301 may be etched, for example by submersing the substrate 300 in a chemical liquid bath for at least 1 hour, until the outer surface 301 is bright. The cleaned substrate 300 may then be placed in a vacuum oven for the coating step 330.

During the coating step 330, the temperature of the vacuum oven may be set to 200° C. and the pressure within the vacuum oven may be reduced to below atmosphere pressure. The vacuum oven may then be filled with nitrogen gas, such that a first deposition process of the coating occurs in a nitrogen environment. A titanium source positioned within the vacuum oven, a distance apart from the substrate 300, may be energized to deposit titanium ions by chemical ionization onto the outer surface 301. The ionized titanium layer may form a conformal first layer 302 on the outer surface 301, such that the first layer 302 has substantially the same geometry as the outer surface 301. The vacuum oven may then be purged of the nitrogen gas and filled with an oxygen-containing gas, such that a second deposition process of the coating occurs in an oxygen-containing environment. A zirconium source and a chromium source positioned within the vacuum oven, a distance apart from the substrate 300, may be energized to deposit chromium oxide ions and zirconium dioxide ions by chemical ionization onto the first layer 302. The ionized chromium oxide and zirconium dioxide layer may form a conformal second layer 304 on the first layer 302, such that the second layer 304 has substantially the same geometry as the first layer 302 (and thus outer surface 301). A third deposition process of the coating may also occur in an oxygen-containing environment. The vacuum oven may be purged after the second layer deposition and re-filled with an oxygen containing gas, or the oxygen-containing environment of the second layer deposition process may remain in the vacuum oven for the third deposition process. A zirconium source positioned within the vacuum oven, a distance apart from the substrate 300, may then be energized to deposit zirconium ions by chemical ionization onto the second layer 304. The ionized zirconium layer may form a conformal third layer 306 on the second layer 304, such that the third layer 306 has substantially the same geometry as the second layer 304 (and thus outer surface 301). The first, second and third layers 302, 304, 306 form the coating 305 deposited on the substrate 300. The outer surface of the third layer 306 forms a planar working surface 303 (having corresponding geometry with the outer surface 301 on which the coating 305 is applied). The coating step 330 may include leaving the substrate 300 in the heated vacuum oven at 200° C. for about 2 hours while the ionized titanium and zirconium are being deposited.

Although FIG. 3 shows a method of depositing three layers having different compositions to form a conformal coating having a majority composition titanium and zirconium on a substrate, more or less than three layers may be deposited to form the conformal coating. Further, a different order of deposition may be utilized, for example, where ionized titanium is deposited after depositing ionized zirconium dioxide. In some embodiments, additional ionized metallic and/or ceramic sources may be provided in the vacuum oven during deposition.

According to embodiments of the present disclosure, heat transfer elements may be formed by coating a substrate with at least one layer having a metallic composition and at least one layer having a ceramic composition, where the coating has a composition of at least 50 percent by mass of titanium and zirconium. For example, heat transfer elements according to some embodiments of the present disclosure may be formed using multiple deposition processes by coating a substrate with at least one metallic layer having ionized titanium and at least one ceramic layer having ionized zirconium dioxide. According to some embodiments, heat transfer elements may be formed using one or more deposition processes to provide a metallic-ceramic composite coating on a substrate, where the coating has a composition of at least 50 percent by mass of titanium and zirconium.

Heat transfer elements of the present disclosure may have improved ion production when heated and relatively higher glossiness when compared to heat transfer elements previously used in hair irons. Further, heat transfer elements of the present disclosure may have an improved life time and durability. For example, in a performance comparison test, heat transfer elements made according to embodiments of the present disclosure having a coating with a majority titanium and zirconium deposited by chemical ionization onto an outer surface of a substrate were heated up to 220° C. and loaded with 600 grams of weight at 40 cycles per minute. Comparison samples made of a substrate coated with a majority titanium (without zirconium) by chemical ionization were also heated up to 220° C. and loaded with 600 grams of weight at 40 cycles per minute. The heat transfer elements of the present disclosure had an average life time of about 100,000 cycles while the comparison samples had an average life time of about 50,000 cycles.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A hair iron, comprising:

at least one heat transfer element, comprising:

a substrate; and a coating deposited on the substrate, the coating having a composition comprising at least 50 percent by mass of titanium and zirconium;

a heating element; and a thermally insulated grip region.

2. The hair iron of claim 1, wherein the coating comprises greater than 50 percent and up to 75 percent of titanium.

3. The hair iron of claim 1, wherein the coating comprises between 1 and 10 percent of zirconium.

4. The hair iron of claim 1, wherein the coating comprises at least three layers, a first layer comprising ionized titanium, a second layer comprising ionized chromium oxide and zirconium dioxide, a third layer comprising ionized zirconium.

5. The hair iron of claim 1, wherein the coating has a glossiness greater than 400 GU.

6. The hair iron of claim 1, wherein the coating forms a planar outer surface of the at least one heat transfer element.

7. The hair iron of claim 1, wherein the coating forms a non-planar outer surface of the at least one heat transfer element.

8. The hair iron of claim 1, wherein the substrate is a metallic substrate comprising at least one metal selected from the group consisting of aluminum, brass, copper, gold, and silver.

9. The hair iron of claim 1, further comprising an ion generator, the ion generator including a power supply, an anode and a cathode.

* * * * *